US005083578A

United States Patent [19]

Agarie et al.

[11] Patent Number: 5,083,578

[45] Date of Patent: Jan. 28, 1992

[54] APPARATUS FOR REMOVING TOXIC MATERIALS CONTAINED IN TOBACCO AND METHODS THEREFOR

[76] Inventors: Yukinobu Agarie, 6-22, Asato 2-chome, Naha, Okinawa, 902; Seiji Irimaji, 18-19, Kohagura 2-chome, Naha, Okinawa, 900, both of Japan

[21] Appl. No.: 428,295

[22] Filed: Oct. 26, 1989

[30] Foreign Application Priority Data

Oct. 26, 1988 [JP] Japan ..... 63-270273

[51] Int. Cl.[5] ..... A24D 3/14

[52] U.S. Cl. ..... 131/331; 131/346

[58] Field of Search ..... 131/351, 331, 341, 346

[56] References Cited

U.S. PATENT DOCUMENTS 1,954,109 4/1934 Whitaker ..... 131/352

*Primary Examiner*—V. Millow

*Attorney, Agent, or Firm*—Lowe, Price, Leblanc and Becker

[57] ABSTRACT

An apparatus and method for removing toxic materials from tobacco which comprises a filter element which includes a seaweed. In use, the apparatus removes toxic materials from tobacco vapors which pass through the filter element.

14 Claims, 3 Drawing Sheets

(B)

| NUMBER OF CIGARETTE | NICOTINE | TAR |
|---|---|---|
| 1 | 0.9 | 14 |
| 2 | 0.8 | 13 |
| 3 | 0.8 | 13 |
| 4 | 0.8 | 12 |
| 5 | 0.7 | 12 |
| 6 | 0.7 | 12 |
| 7 | 0.7 | 12 |

(UNIT : MILLIGRAM)

Fig. 5A
PRIOR ART

| NUMBER OF CIGARETTE | NICOTINE | TAR |
|---|---|---|
| 1 | 0.5 | 5 |
| 2 | 0.3 | 4 |
| 3 | 0.3 | 3 |
| 4 | 0.3 | 3 |
| 5 | 0.3 | 3 |
| 6 | 0.3 | 3 |
| 7 | 0.4 | 3 |
| 8 | 0.4 | 3 |
| 9 | 0.4 | 3 |

(UNIT : MILLIGRAM)

Fig. 5B

APPARATUS FOR REMOVING TOXIC MATERIALS CONTAINED IN TOBACCO AND METHODS THEREFOR

BACKGROUND OF THE INVENTION

The present invention relates to an apparatus for removing toxic materials contained in tobacco, including particulate components such as nicotine or tar, gaseous components and carcinogens, and a method therefor.

Generally speaking, air-conductive filters such as acetate fiber filters are used for removing toxic materials contained in tobacco, especially nicotine and tar, but their absorption abilities are low and they cannot sufficiently trap toxic gaseous materials and carcinogens. A material with a high absorption ability, such as an active carbon, may be used in parallel with these filters, but this is not welcomed by smokers because it adversely affects the tobacco taste. Nevertheless, to minimize the amount of toxic material entering their bodies, smokers should consider the removal of toxic materials from tobacco smoke as a matter of routine. This can be done by using an auxilliary tool such as a cylindrical filter. The inventors of this invention have performed a lot of research on the removal of toxic materials from tobacco smoke and have made the following findings. Tangle and coastal seaweed contain 32% by weight of alginic acid, 20–35% by weight of laminarin, 20% by weight of laminin, 20–35% by weight of mannitol, up to 2% by weight of riboflavin (vitamin B2) and other components. These components have an afinity for water-soluble materials existing in tobacco smoke and have a high ratio of absorbance of nicotine and tar, and further, can remove carcinogens.

SUMMARY OF THE INVENTION

The present invention provides an apparatus for removing toxic and carcinogenic material contained in tobacco. It mainly contains substances derived from tangle family and coastal seaweeds.

In the present invention tangle family and coastal seaweeds are processed to produce alginic acid, laminarin, laminin, mannitol and riboflavin in particulate form or cotton or wool-like form, or as a liquid extract mainly comprising these constituients. These products are then formed into a single body, or distributed or mixed into a carrier, such that they can be used to remove toxic and carcinogenic materials contained in tobacco.

As is well known, tobacco contains carbohydrate and other components. When the tobacco is lit for smoking, a gaseous phase is produced at a high temperature, thereby creating tobacco smoke. The combined effect of algin acids, laminarin, laminin, mannitol, riboflavin and other components drived from tangle family and coastal seaweed can very efficiently absorb the toxic and carcinogenic materials contained in tobacco smoke.

BRIEF DESCRIPTION OF THE DRAWINGS

FIGS. 5A and 5B show the result of the experimentation of the present invention as compare with that of the prior art.

DESCRIPTION OF THE PREFERRED EMBODIMENT

Several embodiments of a remover according to the present invention will be recited in detail hereinafter.

Coastal seaweeds, tangle family, agar-agar or wakame may be utilized.

1. These seaweeds are desiccated and thereafter broken into a powder or particulate state, or they may be manufactured into a cotton or wool-like state through a cutting process. The resulting substance, is installed into a cylindrical paper filter. This filter may be combined with a cigarette or installed into a cylinder as an auxiliary device.

2. These seaweeds are chopped by, for example, a mixer, made into a water-soluble, state and then sprinkled onto a carrier such as a filter paper and absorbed. The filter paper is then manufactured into a predetermined form such as a cylinder shape and dried so that it can be used as a filter directly connected to a cigarette, or installed into a cylinder as an auxiliary device.

3. These seaweeds are made into a fine powder by a mixer and then scattered by means of a jet spray onto a carrier such as a filter paper and thus absorbed.

4. These seaweeds are broken into a fine water-soluble powder by a mixer and further may be manufactured into cotton or wool-like states by a cutting process. The manufactured member is formed by mixing powder particles with carriers of an infinite variety of shapes, to form a filter. The manufactured filter is either connected directly to a cigarette or used as an auxiliary tool.

The filter of the present invention, structured as described above, is obtained by processing a seaweed into a material which can absorb the vapor component of tobacco smoke which is produced upon lighting. This increases the affinity of the paste-like filter material to the water-soluble niconine and tar passing through it, thus increasing its absorption ability. This is an improvement over the conventional filter. Further the extraction solution of the present invention contains algin acids, laminarin, laminin, mannitol, riboflavin and other components. The components make nicotine and tar water-soluble so that they are absorbed by the filter, thus preventing them from entering the human body. If a smoker smokes a cigarette using a filter containing a liquid extract of the present invention, he will be well protected from nicotine and tar. In addition, as nicotine and tar are removed from the smoker's tobacco smoke, people in the smoker's environment are also protected.

Figure 1A:
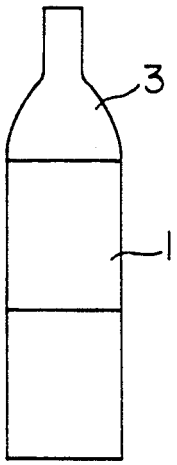
FIGS. 1A and 1B and 2 show side views of an embodiment of the filter according to the present invention.
Figure 1B:
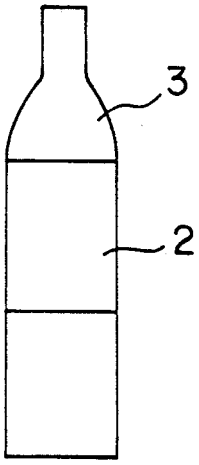

A preferred embodiment of a cylinder containing a filter of the present invention is shown in FIG. 1. FIG. 1(A) shows a cylinder comprising a transparent body 3 containing an acetate fiber filter 1. This is used for an ordinary cigarette. FIG. 1(B) shows a cylinder comprising a transparent body 3 containing a filter 2 made of a tangle family cotton-like filter. Cylinders equipped with a tangle family, cotton-like filter as shown in FIG. 1(B) are initially white, like the pipe shown is FIG. 1(A).

Figure 2:
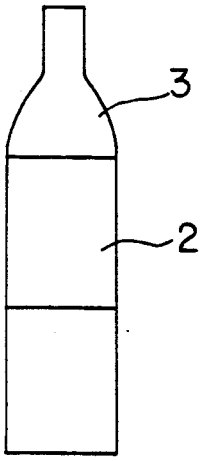

When the smoker has smoked a single cigarette, the acetate fiber filter 1 as shown in FIG. 1 is still white, but the tangle family cotton-like filter 2 has changed to dark brown, as shown in FIG. 2(B), the absorbance of toxic material.

This shows how efficiently the filter of the present invention absorbs toxic material. As more cigarettes are smoked, the filter of the present invention becomes a progressisvely darker brown and progressively wetter, from absorbing tar and nicotine.

This demonstrates the excellent ability of the present invention to selectively absorb toxic smoke components. The smell and taste of tobacco is also made very much milder. This excellent capability and efficiency in removing toxic smoke components is not achieved by any other known filter material.

The cylinder 3 shown in FIGS. 1(A) and (B) and in FIG. 2(B) is transparent. By comparing the filters shown in FIG. 1(B) and FIG. 2(B) the smoker can immediately recognise that toxic material is removed, thereby providing a great advantage.

Further, even the tangle family cotton-like manufactured filter 2 quickly becomes brown and then black, showing its increased ability to remove and trap nicotine and tar.

Figure 3:
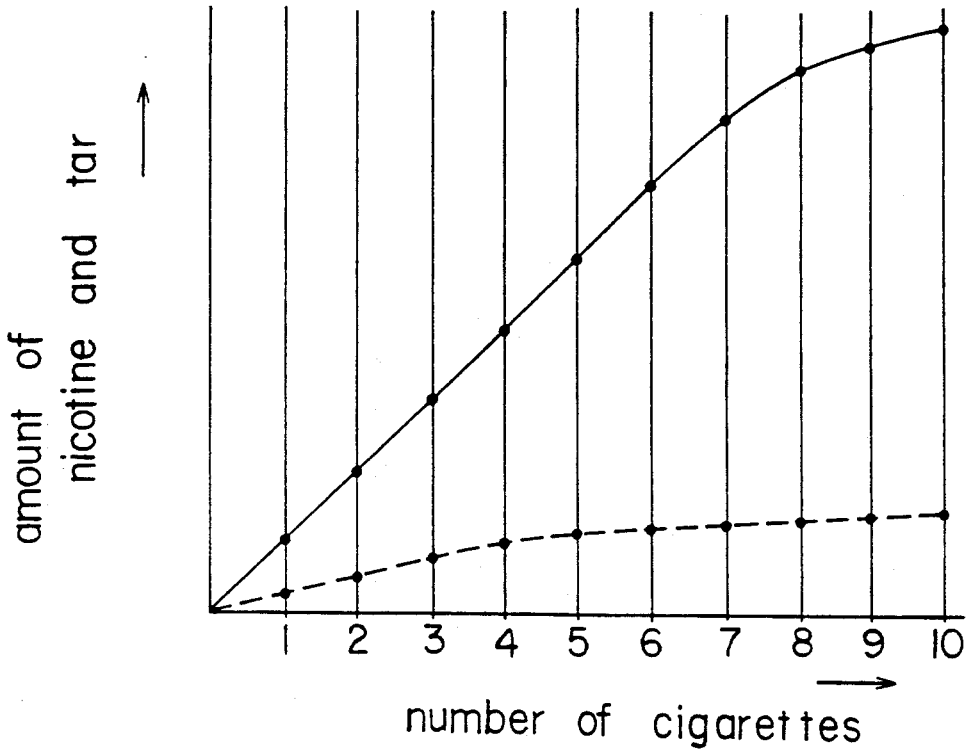
FIG. 3 shows a graph which compares the filter of the present invention with the conventional acetate filter, with regard to the amount of nicotine and tar removed, versus the number of cigarettes smoked.
Figure 4:
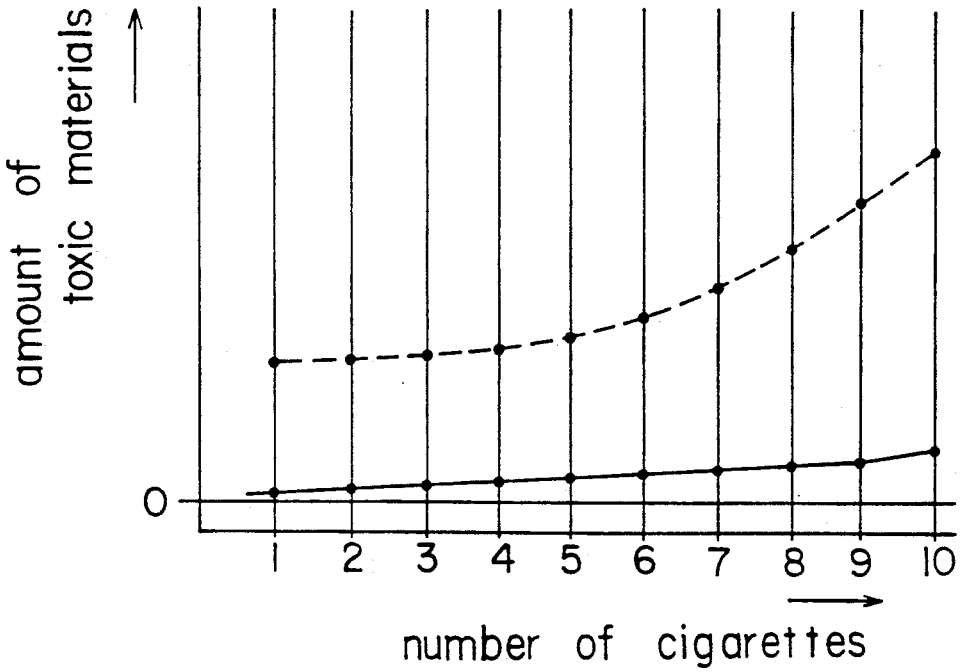
FIG. 4 compares the filter of the present invention with the conventional acetate filter, with regard to the amount of toxic materials remaining in the tobacco smoke, after passing through the filter.

FIGS. 3 and 4 compare the abilities of the filter of the present invention (hereinafter called tangle family manufactured filter) and of a convention acetate fiber filter to absorb nicotine and tar. Respective cylinders are equipped with a different type of filter. Then a cigarette is inserted into each cylinder and lit. A suction force for a predetermined filter length is then applied to each cigartette, thereby causing the tobacco smoke to pass through the respective filters. Thereafter, the respective filters are detached from the pipes and the amounts of absorbed nicotine and tar are measured.

Similarly, three, four, five . . . ten cigarettes are measured to determine the amount of nicotine and tar absorbed. The data applying to the filter of the present invention are shown by a solid line in FIG. 3, and the data applying to the conventional filter are shown for comparison by a dotted line. As shown the filter of the present invention achieves several times the absorption ability of the conventional filter and maintains its ability for a long time.

FIG. 4 shows the amount of toxic material remaining in the smoke passing through the filter. The solid line indicates the value for the present invention and the dotted line that for the conventional filter.

A visual test shows that the end surface of the acetate pipe filter (conventional example) is almost white after a single cigarette is smoked. In contrast, the end surface of the tangle family-manufactured filter (the present invention) is distinctly brown. After two or three cigarettes have been smoked the tangle family-manufactured filter is a much darker brown than the acetate fiber filter.

The taste and smell of the cigarettes with the tangle family-manufactured filter are very mild and a selectively of absorption capability is found to exist with regard to the components or materials of tobacco smoke. In the above embodiment, the remover of the present invention is recited only as a filter but it can be inserted in the mouth mixed with water, to remove and dissolve nicotine and tar adhering to the teeth.

The present invention as recited above in detail, can effectively remove toxic material contained in tobacco by the combined effect of algin acids, laminarin, laminin, mannitol and riboflavin which are components of and are manufactured from coastal seaweed.

FIGS. 5A and 5B show the result of the experimentation of the present invention as compare with that of the prior art. In both the present invention and the prior art, the amount of the nicotine and tar decrease in accordance with the number of the cigarettes tested. However, the amount of the content of nicotine and tar is greatly reduced in the present invention as compared with the prior art device.

What is claimed is:

1. An apparatus for removing toxic materials from tobacco which comprises a filter element which includes a seaweed.

2. An apparatus for removing toxic materials from tobacco according to claim 1, wherein said seaweed is selected from the group consisting of coastal seaweeds, tangle family seaweeds, agar-agar, wakame, and mixtures thereof.

3. An apparatus for removing toxic materials from tobacco according to claim 2, wherein said seaweed is particulated.

4. An apparatus for removing toxic materials from tobacco according to claim 2, wherein said seaweed is fibrous.

5. An apparatus for removing toxic materials from tobacco according to claim 2, wherein said seaweed is a liquid extract.

6. An apparatus for removing toxic materials from tobacco according to claim 1, wherein said filter element further includes a carrier which supports said seaweed.

7. A method for removing toxic materials from tobacco which comprises passing vapors from said tobacco through a filter element which includes seaweed.

8. A method for removing toxic materials from tobacco according to claim 7, wherein said seaweed is selected from the group consisting of coastal seaweeds, tangle family seaweeds, agar-agar, wakame, and mixtures thereof.

9. A method for removing toxic materials from tobacco according to claim 8, wherein said seaweed is particulated.

10. A method for removing toxic materials from tobacco according to claim 8, wherein said seaweed is fibrous.

11. A method for removing toxic materials from tobacco according to claim 8, wherein said seaweed is a liquid extract.

12. A method for removing toxic materials from tobacco according to claim 8, wherein said filter element further includes a carrier which supports said seaweed.

13. A method for removing toxic materials from tobacco according to claim 7, wherein said toxic materials are selected from the group consisting of nicotine, tar, gaseous components, carcinogens, and mixtures thereof.

14. A method for removing toxic materials from tobacco according to claim 7, wherein said vapors are formed by combusting said tobacco.

* * * * *